US006907988B2

(12) United States Patent
Jimenez

(10) Patent No.: US 6,907,988 B2
(45) Date of Patent: Jun. 21, 2005

(54) PAINT BRUSH COVER

(76) Inventor: Carlos D. Jimenez, P.O. Box 24035, Albuquerque, NM (US) 87502

( * ) Notice: Subject to any disclaimer, the term of this patent is extended or adjusted under 35 U.S.C. 154(b) by 0 days.

(21) Appl. No.: 10/616,446

(22) Filed: Jul. 9, 2003

(65) Prior Publication Data

US 2005/0006262 A1 Jan. 13, 2005

(51) Int. Cl.[7] ..... B65D 83/10
(52) U.S. Cl. ..... 206/362.4; 206/15.3; 229/87.01
(58) Field of Search ..... 206/15.3, 361, 206/362.4, 1.7, 495; 229/87.01

(56) References Cited

U.S. PATENT DOCUMENTS 4,606,456 A * 8/1986 Kaminski ..... 206/362.4
5,791,608 A * 8/1998 Nielsen et al. ..... 248/110
2001/0047948 A1 * 12/2001 Cummings et al. ..... 206/362.4
2003/0062280 A1 * 4/2003 Davis ..... 206/362.4
2003/0135945 A1 * 7/2003 Nordstrom ..... 15/168

* cited by examiner

*Primary Examiner*—David T. Fidei

(57) ABSTRACT

The device of the present invention is a durable yet light-weight paint brush cover which can be used to cover paint brushes of multiple sizes. The device is essentially comprised of a flap portion and a wrap portion, with the portions being attached at a variable width interface portion. This variable width interface portion allows the wrap portion and flap portion to be easily folded over an inserted paint brush of any conventional size. The device is constructed with a durable material which will withstand multiple uses without significant wear, thus allowing the device to be used over a long period of time.

4 Claims, 8 Drawing Sheets

PAINT BRUSH COVER

FIELD OF THE INVENTION

The present invention relates generally to protective coverings for paint brushes.

BACKGROUND OF THE INVENTION

Paint brushes, while individually relatively inexpensive, when cumulatively assessed, can be a large expenditure for businesses in the painting field. Proper care of a paint brush can dramatically increase the life of a paint brush, thus significantly reducing the amount of total expenditures.

Additionally, paint brushes are used to apply paint which, by its very nature, is intended to permanently alter the appearance of a surface. At the very least, removing paint from an undesired surface can be a difficult and time intensive task. Even if the brush is cleaned before storing, the brush may be moist with water or a paint solvent which may have undesirable effects on adjacent surfaces. Thus, it is desirable to store a paint brush in a cover when not using it in order to protect these surfaces.

The prior art discloses brush covers made primarily of paper products. The obvious drawback of these covers is that a paint brush can be moist with paint, water, a paint solvent, or a combination of these. This can cause the paper brush covers to deteriorate rapidly and will provide only limited protection to the brush.

There have been previous attempts to solve the foregoing problem. One example, U.S. Pat. No. 5,791,608 to Nielsen et al., discloses a magnetized brush and tool retainer. This cover for paint brushes and tools utilizes magnetic materials to secure a paint brush or other tools in place within the cover. The largest single drawback of the device is that a different sized cover must be chosen depending on the size of brush being used. For instance, based on the fact that front panel 20, as disclosed in that patent, is of a fixed width and is of an equal width of central panel 12, the cover will only be of use for a brush of the same dimensions as the inside dimension of the device. This is obvious as Nielsen discloses seven different dies or outlines in FIG. 6. Additionally, the magnets used to secure the brush or tools in place cause excess weight within the device which is undesirable if numerous paint brushes must be carried. Furthermore, many paint brushes are made of wood, plastic or composite materials to which a magnet is not attracted.

Therefore, what is needed is a paint brush cover which will securely cover desired portions of a paint brush and which is adjustable to fit all sizes of normally available paint brushes. Additionally, a paint brush cover is desired that does not require any magnetic attraction between the cover and the brush. Finally, a paint brush cover is needed that is not only adjustable, but is also durable.

OBJECTS OF THE INVENTION

It is an object of the current invention to provide a paint brush cover which will preserve and protect a paint brush.

It is still yet another object of the present invention to provide a paint brush cover which can be adjusted to fit most commercially available paint brushes.

It is still a further object of the present invention to provide a paint brush cover which is made of a material which is both durable, flexible, light weight and absorbent.

The foregoing and other objects will be apparent from the drawings and the description set forth herein.

SUMMARY OF THE INVENTION

The current invention relates to a cover for paint brushes which protects both a paint brush and surfaces adjacent the paint brush. In the field of paint brushes, there are two general shapes: 1) a flat brush (commonly called a swan brush), and 2) a corner brush (commonly called a sash brush). Within these two general shapes, paint brushes come in various widths and lengths depending on the application the brush is being used for. The paint brush cover of the present invention, in one embodiment, is constructed such that most commercially available sizes of brushes can be secured within the cover.

All embodiments of the current invention utilize a wrap portion to enclose a paint brush. The paint brush will be placed in approximately the middle of this wrap portion and the portions of the wrap portion extending beyond the brush will be folded over the brush and each other. Extending from the middle of the wrap portion is a flap portion. This flap portion is designed to be folded over the bristle end of the brush and the folded wrap portion such that it lies directly on top of the folded wrap portion. While most of the flap portion is substantially rectangular in shape, the interface portion (where the flap portion meets the wrap portion) will, at first, be wider than the flap portion, then narrower, and then tapered into the wrap portion. The special cuts in the material which define this variable width of the interface portion is the feature that allows the brush cover to be capable of accommodating various sizes of paint brushes.

Once the brush is fully enclosed within the wrap and flap portions of the device, a hook and loop fastening system (or equivalent) will be used to secure the folds of the cover device and secure and support the brush within the device. The hook and loop fasteners will be attached to the external surfaces of both the wrap and flap portions, such that when secured around a paint brush, the hook and loop fasteners will fully secure the cover and the brush in place.

DESCRIPTION OF THE PREFERRED EMBODIMENTS

Figure 1:
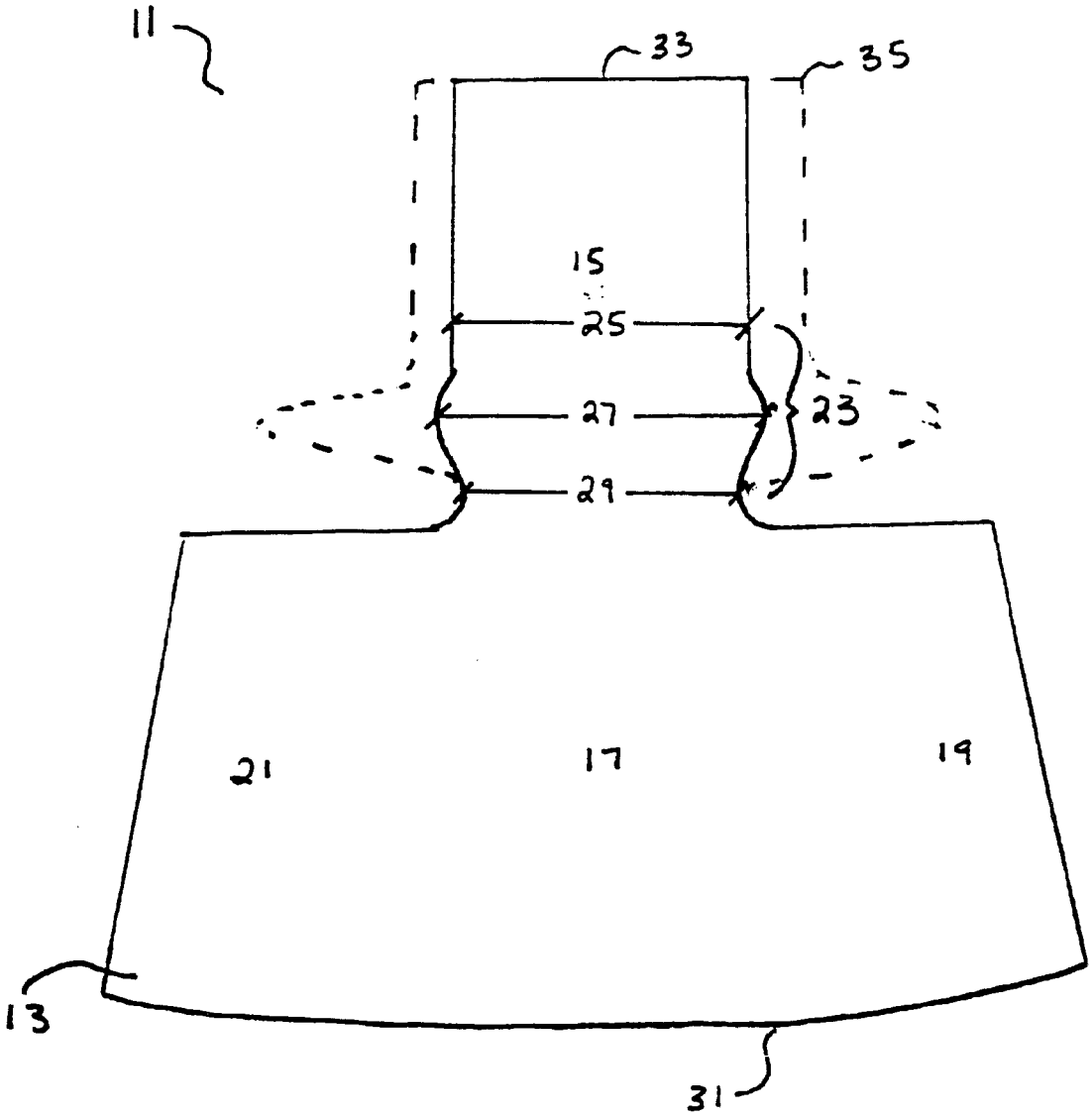
FIG. 1 is an illustration of the internal surface of the paint brush cover in its unfolded formation.
Figure 4:
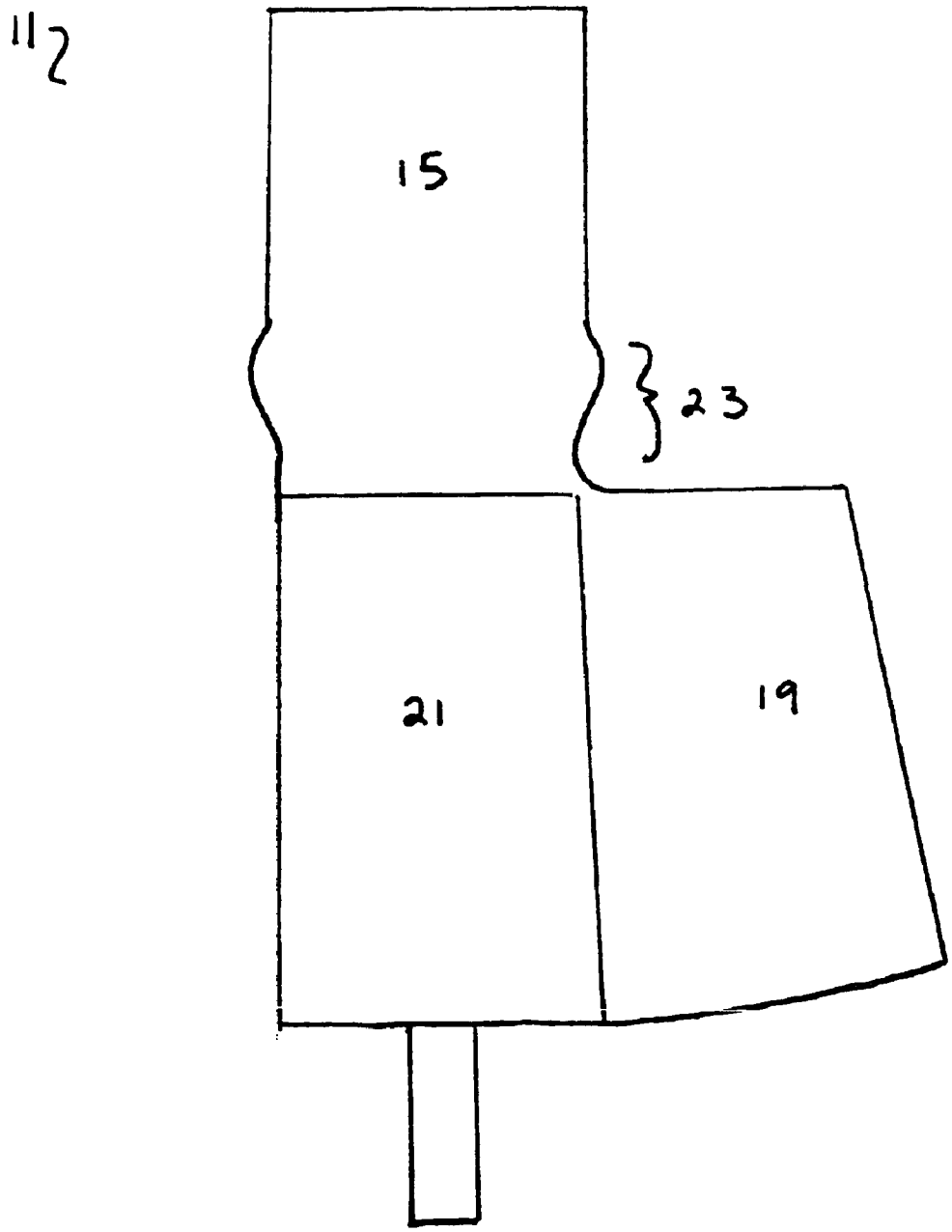
FIG. 4 is an illustration of the paint brush cover after a paint brush has been partially covered by the wrap section
Figure 5:
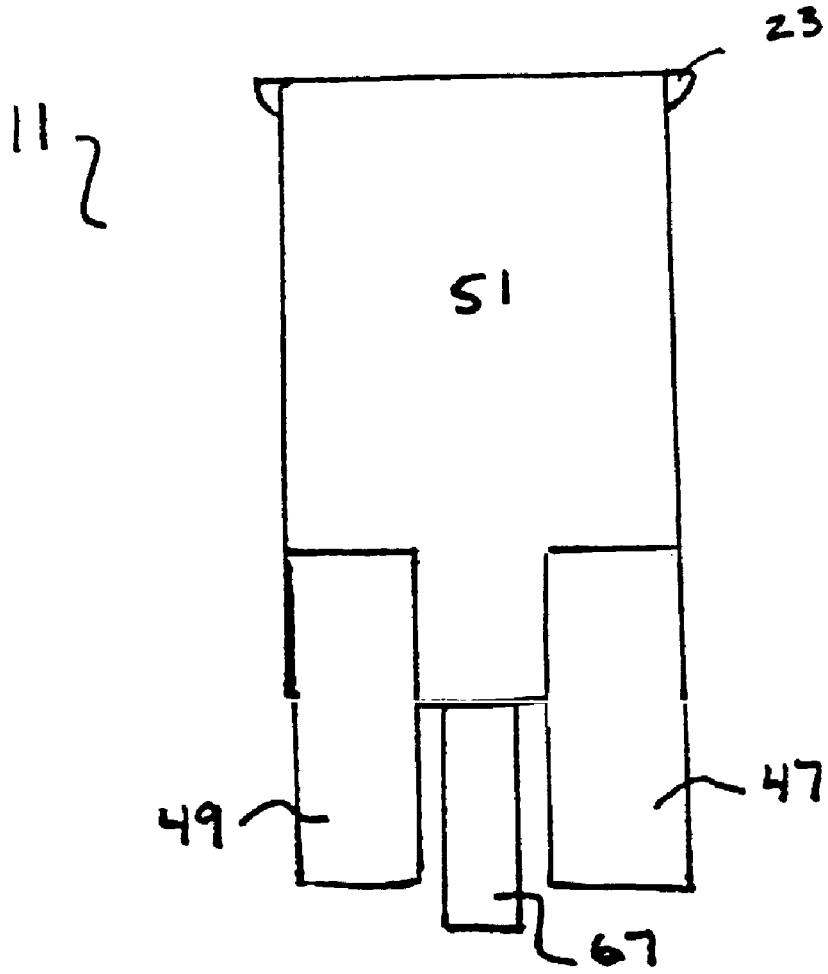
FIG. 5 is an illustration of the paint brush cover

FIG. 1 illustrates one embodiment of the paint brush cover in its unfolded formation. Paint brush cover 11 is comprised of a wrap portion 13 and a flap portion 15. Wrap portion 13 can be divided into three general sections, middle section 17, right section 19 and left section 21. Paint brush cover 11 is arranged such that flap portion 15 is directly adjacent middle section 17 of wrap portion 15 with the two portions being connected by interface 23. While interface 23 is substantially contained within flap portion 15, it is distinguished from the remainder of flap portion 15. FIG. 1 shows that flap portion 15 has a substantially constant width designated by 25. In one embodiment, the width of this flap portion will remain fixed, and must be set according to the width of the smallest brush to be covered by the invention. In a different embodiment, as the flap portion 15 approaches wrap potion 13, interface 23 has a varying width, widening to a maximum width designated by 27, which is greater than width 25, narrowing to a width 29, which is smaller than width 25. Width 29 must be set according to the width of the smallest brush to be covered by the invention. Finally interface 23 tapers into wrap portion 13. This gradual widening and narrowing of the width within interface 23 allows for flap portion 15 to have a width 25 which may be greater than the width of the smallest brush to be accommodated by paint brush cover 11, thus allowing this one paint brush cover 11 for multiple sizes of paint brushes. As is illustrated with alternate contours 35, an alternate embodiment of interface portion 23 could be used to accommodate oversized brushes while still being capable of accommodating conventional sized brushes. This multiple size accommodation feature is further facilitated through adjusting the widths of middle section 17, right section 19 and left section 21 without changing the overall dimensions of wrap portion 13. For example, for a larger brush, middle section 17 will be wider while, right and left sections 19 and 21 will be proportionately smaller. Alternately, if the brush is smaller in width, middle section 17 will be smaller and right and left sections 19 and 21 will be proportionately larger. In any case, flap portion 15, by virtue of variable width interface section 23, will be able to be easily folded over wrap section 13 and will cover the top of an inserted paintbrush (as shown in FIGS. 3–5) and any portion of the paint brush not covered by right and left sections 19 and 21 when in folded formation, without any additional adjustment to the physical dimensions of paint brush cover 11.

In one embodiment, paint brush cover 11 could be constructed with a canvas material. In different embodiments, other materials which possess both flexibility and durability could be used in place of the canvas.

Figure 2:
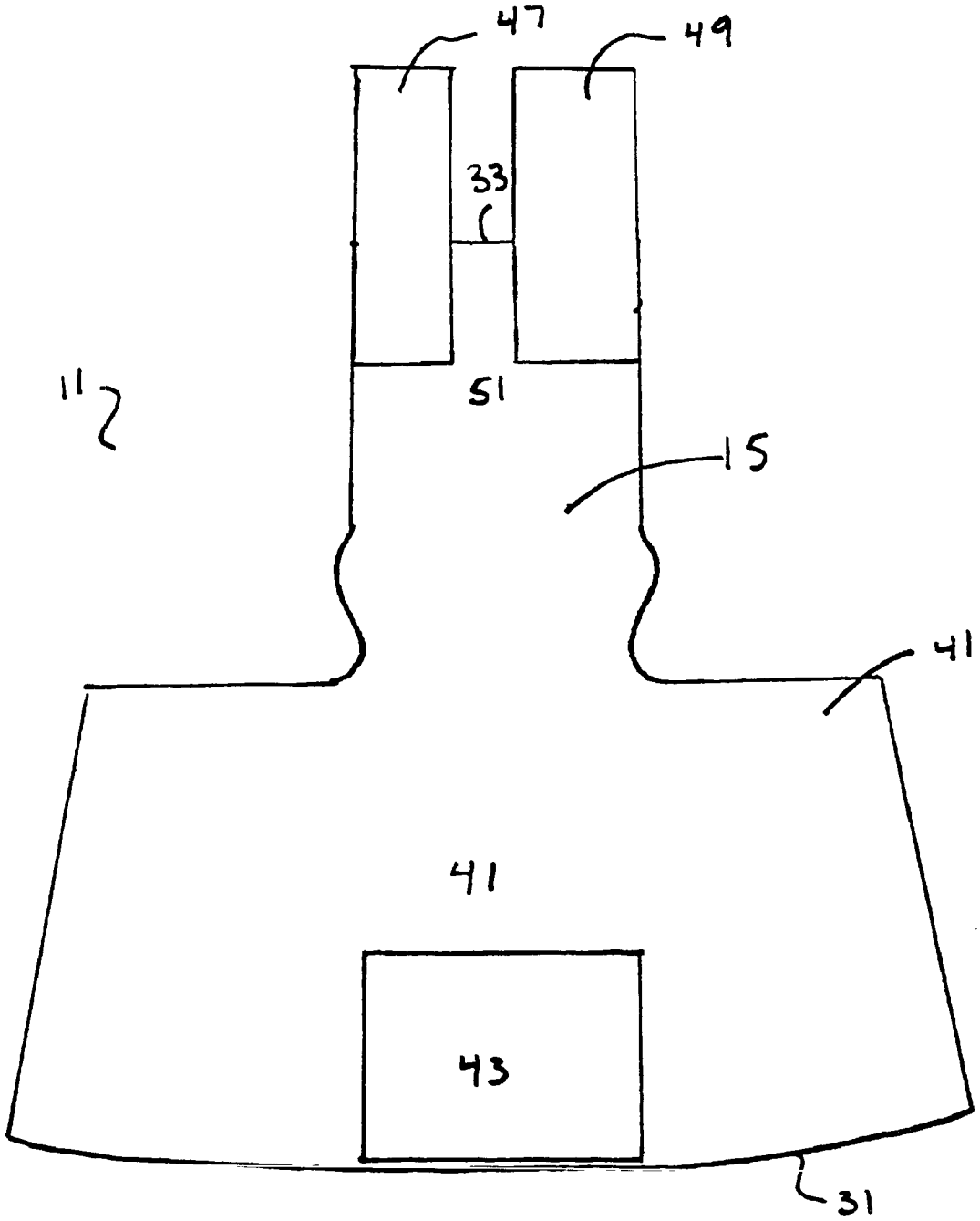
FIG. 2 is an illustration of the external surface and securing mechanism of the paint brush cover in its unfolded formation.

FIG. 2 illustrates the securing mechanism attached to the external surface 41 of paint brush cover 11. The securing mechanism, in one embodiment, is comprised of a coordinated hook and loop system, such as sold under the name VELCRO. The hook material portion 43 is attached to the external surface 41 of middle section 17 nearest edge 31. Accordingly, loop material portions 47 and 49 are attached to and extend beyond edge 33 of external surface 51 of flap portion 15. In a different embodiment, the portion of the device marked 43 could be made of loop material and the portions marked 47 and 49 could be made of hook material. It should be obvious to one skilled in the art that other methods of securing the various sections to each other are possible.

Figure 3:
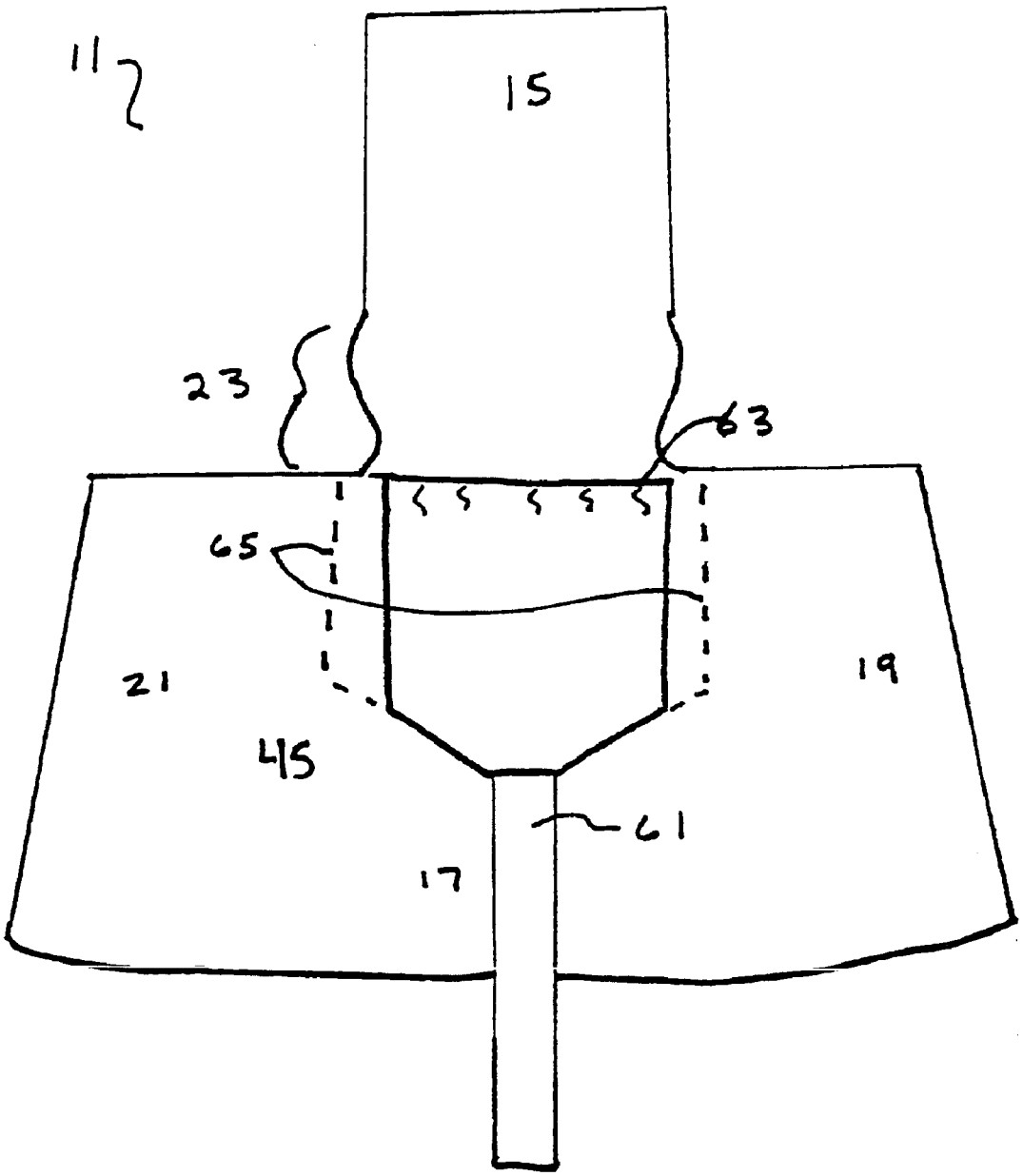
FIG. 3 is an illustration of the interface surface of the paint brush cover in its unfolded formation after a paint brush has been placed on the cover.

FIG. 3 illustrates the proper positioning of a paint brush 61 within the paint brush cover 11 before the device has been folded. Paint brush 61 is positioned on the internal surface 45 of wrap portion 13 of paint brush cover 11 such that the bristles 63 of brush 61 abut, but do not extend into interface 23. As can be seen, multiple lengths of paint brushes can be accommodated so long as the bristles 63 do not extend into interface 23. Alternate brush contours 65 shown in the FIG. 3 represent a different size of paint brush that can be covered by the paint brush cover 11. Again, as described with reference to FIG. 1, multiple sizes of brushes can be accommodated by the paint brush cover 11 due to the varying width of interface 23. In certain embodiments, internal surface 45 may be lined or backed with an additional layer of flexible material to further increase the durability and longevity of paint brush cover 11.

FIG. 4 illustrates the paint brush cover 11, after the paint brush 61 has been positioned, and after left section 21 has been folded to partially wrap paint brush 61. Right section 19 will subsequently be folded over in substantially the opposite direction such that left section 21, right section 19 and middle section 17 wrap paint brush 61.

FIG. 5 illustrates the paint brush cover 11 after paint brush 61 has been fully wrapped by right section 19, left section 21, and middle section 17, and after flap portion 15 has been folded allowing interface 23 to fully enclose the top of paint brush 61 such that only external surface 51 is exposed. As can be seen in the figure, only handle 67 of paint brush 61 is visible and exposed. Loop portions 47 and 49 have not been attached to said hook portion 43 (not shown).

Figure 6A:
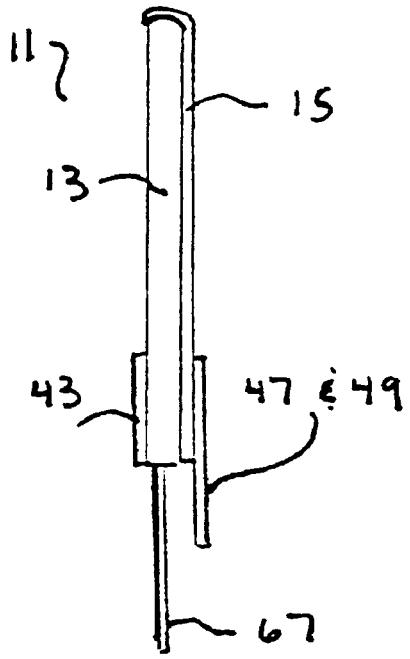
FIGS. 6A and 6B are side views of the present invention illustrating the securing mechanism of the present invention.
Figure 6B:
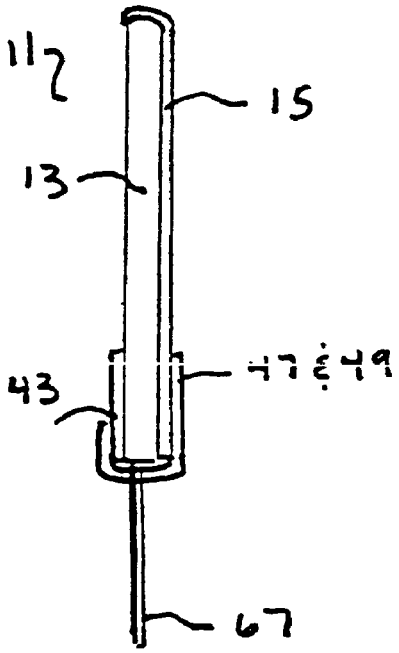

FIGS. 6A and 6B are side views of the paint brush cover device after paint brush 61 has been fully enclosed by wrap portion 13 and flap portion 15. FIG. 6A shows loop portions 47 and 49 before they are attached to hook material 43. In FIG. 6B, loop portions 47 and 49 are engaged with the hook material 43 by manipulating the loop portions to secure both flap portion 15 and wrap portion 13 together when the device is in its folded formation. Additionally, loop portions 47 and 49 will straddle the handle 67 of paint brush 61 such that paint brush 61 is supported from both sides of handle 67.

Figure 7:
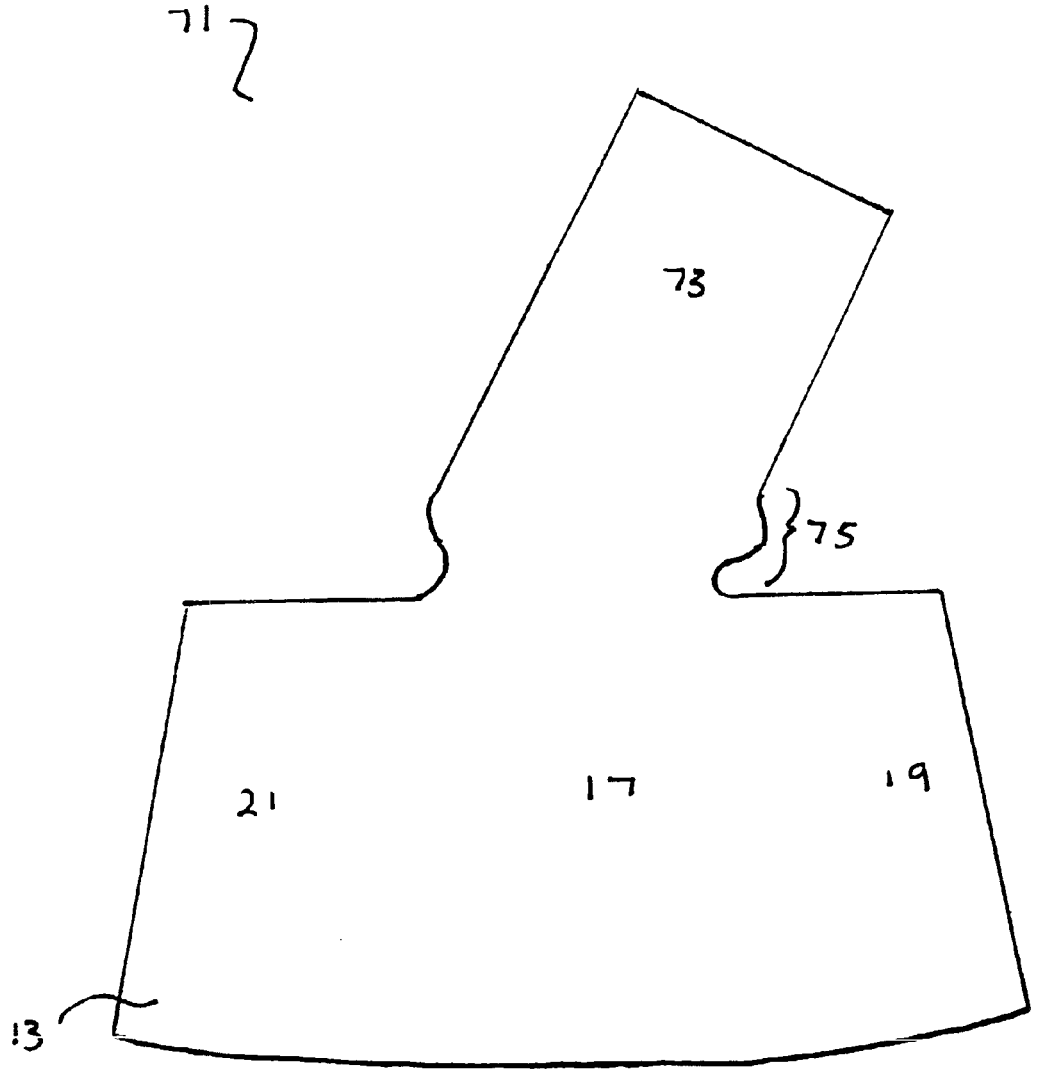
FIG. 7 is an illustration of an alternate embodiment of the paint brush cover specifically tailored for sash type paint brushes.

FIG. 7 is an illustration of an alternate embodiment of the paint brush cover specifically tailored for sash type paint brushes (not shown) whose bristles are disposed at a 45° angle. While previous embodiments of the invention could accommodate a sash type brush, it may be desirable to have a paint brush cover specifically tailored to the shape of the sash brush.

With reference to FIG. 7, sash paint brush cover 71 is substantially the same as previous embodiments of the invention. Wrap portion 13 is the same as previous embodiments, but flap portion 73 is disposed at a 45° angle from the remainder of the paint brush cover such that it will mimic the shape of the sash brush (not shown). Interface section 75 will function precisely as it has been described with reference to previous embodiments.

Figure 8:
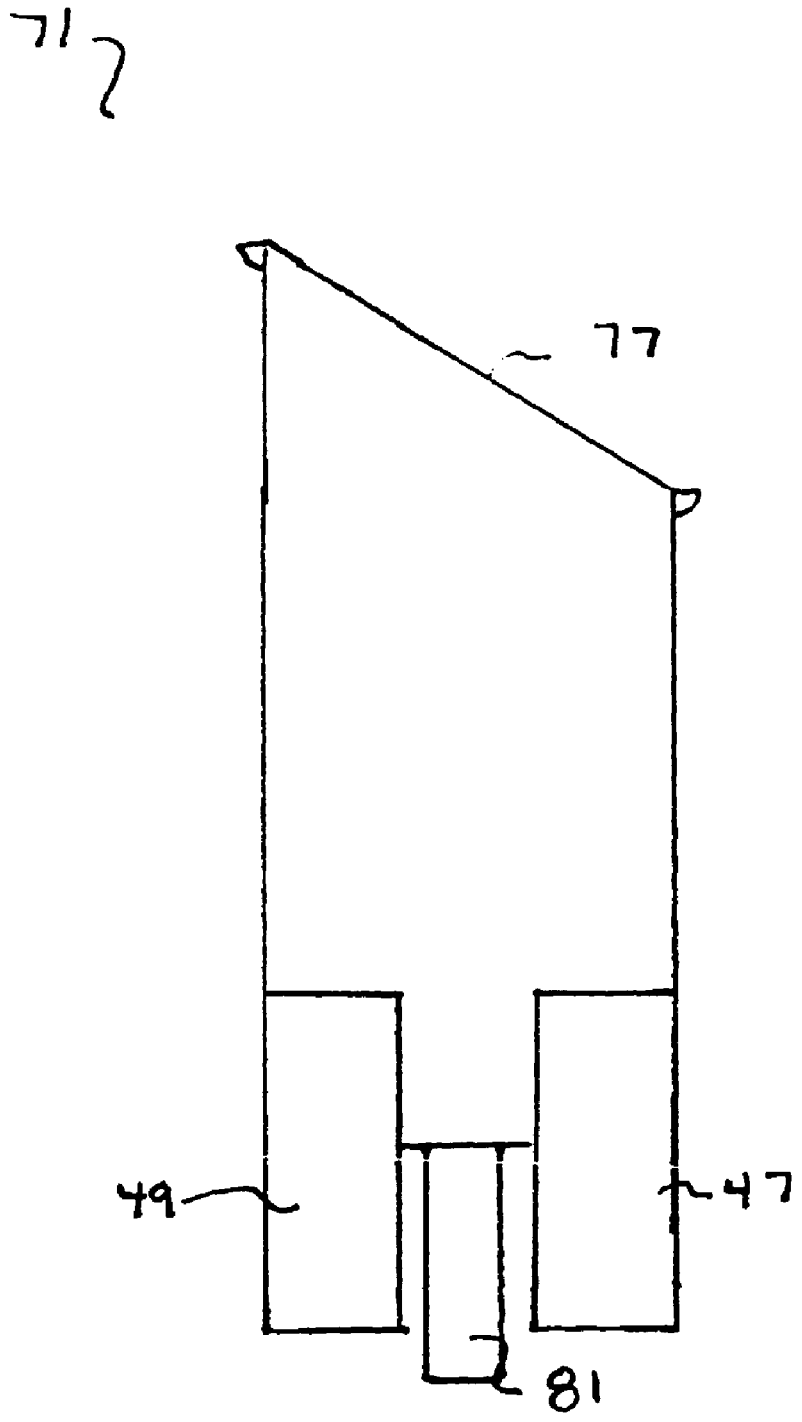
FIG. 8 is an illustration of an alternate embodiment of the paint brush cover specifically tailored for sash type paint brushes after the flap portion has been positioned but not secured with the hook and loop fastening system.

FIG. 8 illustrates the sash paint brush cover 71 after sash paint brush 81 has been fully wrapped by right section 19, left section 21, and middle section 17, and after flap portion 73 has been folded allowing interface 75 to fully enclose the top of sash paint brush 81. As can be seen, when in folded formation, the top surface 77 of sash paint brush cover 71 forms a 45° angle, mimicking the shape of sash paint brush 81. Hook portions 47 and 49 will function precisely as they have been described in the previous embodiments.

Whereas the drawings and accompanying description have shown and described the preferred embodiments, it should be apparent to those skilled in the art that various changes may be made in the form of the invention without affecting the scope thereof.

I claim:

1. A paint brush cover comprising:

a. a substantially quadrilaterally shaped wrap portion being made of a durable, flexible material, said wrap portion including right, middle and left sections, all of said sections having an internal surface and an external surface, and all of said sections being able to be folded over each other, said middle section having a first edge and a second edge;

b. a flap portion being made of said durable, flexible material having a first edge, a flexible interface region, a constant width region, an internal surface and an external surface, said flap portion capable of being placed in a folded formation such that it covers at least a portion of said wrap portion and capable of covering paint brushes of different lengths, said flexible interface region of said flap portion being integrally attached to said first edge of said middle section said interface region having a varying width to accommodate paint brushes of different sizes, side interface region having a minimum width set to the width of the smallest paint brush desired to be covered by said device; and c. means for securing said flap portion in place when in said folded formation, said means for securing contemporaneously securing a paint brush within said wrap portion said means for securing being removeably attached to said external surface of said middle section to be extended under the handle of a paint brush and removeably attached to said external surface of said flap portion, each of said means for securing being positioned on opposite sides of a handle of said paint brush upon covering.

2. The paint brush cover of claim 1, wherein said means for securing said flap portion to said wrap portion and securing said paint brush within said wrap portion is comprised of a coordinated fastening system having a hook component and a loop component, one of said hook and loop components being attached to one of said external surface of the top region of said flap portion or said external surface of the bottom region of said middle section, the other of said hook and loop components being attached to the other of said regions.

3. The paint brush cover of claim 1, wherein said durable material is canvas.

4. The paint brush cover of claim 1, further comprising a lining attached to said internal surface of said durable, flexible material.

* * * * *